US006558212B2

(12) United States Patent
Saito

(10) Patent No.: US 6,558,212 B2
(45) **Date of Patent: *May 6, 2003**

(54) HYDRAULIC TILT DEVICE FOR MARINE OUTBOARD DRIVE

(75) Inventor: Hideki Saito, Kakegawa (JP)

(73) Assignee: Sogi Kabushiki Kaisha, Shizuoka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,998

(22) Filed: Aug. 20, 1999

(65) Prior Publication Data

US 2003/0013358 A1 Jan. 16, 2003

(30) Foreign Application Priority Data

Aug. 20, 1998 (JP) ..... 10-233386

(51) Int. Cl.[7] ..... B63H 20/08; B63H 5/125
(52) U.S. Cl. ..... 440/56; 440/53
(58) Field of Search ..... 440/53, 56, 61

(56) References Cited

U.S. PATENT DOCUMENTS

| | | | | | |
|---|---|---|---|---|---|
| 3,842,789 | A | | 10/1974 | Bergstedt | |
| 3,888,203 | A | * | 6/1975 | Lohse | 440/57 |
| 4,308,018 | A | * | 12/1981 | Nakamura et al. | 440/61 |
| 4,545,769 | A | * | 10/1985 | Nakahama et al. | 440/61 |
| 4,551,104 | A | * | 11/1985 | Iwashita et al. | 440/56 |
| 4,557,696 | A | | 12/1985 | Nakahama | |
| 4,575,342 | A | | 3/1986 | Nakahama et al. | |
| 4,695,260 | A | | 9/1987 | Suzuki et al. | |
| 4,702,714 | A | | 10/1987 | Nakase | |
| 4,778,414 | A | | 10/1988 | Taguchi | |
| 4,784,625 | A | | 11/1988 | Nakahama | |
| 4,813,896 | A | | 3/1989 | Koike et al. | |
| 4,909,766 | A | | 3/1990 | Taguchi | |
| 4,990,111 | A | | 2/1991 | Saitoh et al. | |
| 5,007,866 | A | | 4/1991 | Okita | |
| 5,018,994 | A | | 5/1991 | Okita | |
| 5,049,099 | A | | 9/1991 | Ito et al. | |
| 5,067,919 | A | | 11/1991 | Okita | |
| 5,366,393 | A | | 11/1994 | Uenage et al. | |
| 5,368,509 | A | * | 11/1994 | Tsujii | 440/56 |
| 5,489,226 | A | * | 2/1996 | Nakamura et al. | 440/61 |
| 5,720,637 | A | * | 2/1998 | Nakamura | 440/61 |
| 6,015,318 | A | | 1/2000 | Uematsu et al. | |
| 6,042,434 | A | * | 3/2000 | Nakamura | 440/61 |

* cited by examiner

*Primary Examiner*—S. Joseph Morano
*Assistant Examiner*—Andy Wright
(74) *Attorney, Agent, or Firm*—Knobbe, Martens, Olson & Bear LLP

(57) ABSTRACT

A hydraulic tilt device for a marine outboard drive comprising a cylinder and a piston slidably supported in the cylinder and defining a first and a second chambers. A working fluid is contained in both of the chambers. A piston rod extends from the piston through the first chamber. The first and second chambers are joined together by a passage that is opened or closed by a switchover valve. Gasses are also contained for compensating the working fluid and pressuring it in the first chamber. Means is provided for permitting flow of the working fluid from the second chamber to the first chamber when the passage is closed and the second chamber produces a pressure greater than a predetermined magnitude. The gasses are dispensable if a fluid reservoir is provided for compensating the working fluid.

33 Claims, 8 Drawing Sheets

HYDRAULIC TILT DEVICE FOR MARINE OUTBOARD DRIVE

BACKGROUND OF THE INVENTION

1. Field of the Invention

This invention relates to a hydraulic tilt device for a marine outboard drive and more particularly to an improved hydraulic tilt device that affords good operational performance for a relatively small outboard drive.

2. Description of Related Art

Marine outboard drives, i.e., both outboard motors and the outboard drive sections (stern drives) of inboard motors, have a wide variety of hydraulic tilt devices that support the outboard drives for tilting movement relative to an associated watercraft about a generally horizontally disposed tilt axis. The hydraulic tilt device generally comprises a cylinder, a piston slidably supported in the cylinder and defining a pair of fluid chambers and a piston rod extending from the piston through one of the fluid chambers. The fluid chambers are filled with a working fluid. Either one of the cylinder or piston rod is affixed to a cramp bracket and the other one is affixed to a swivel bracket. The cramp bracket is mounted on the associated watercraft, while the swivel bracket directly supporting the outboard drive is pivotally mounted on the cramp bracket about a tilt axis. Accordingly, when the piston rod comes out of the cylinder with the activation of the working fluid, the swivel bracket pivots about the tilt axis and the outboard drive is tilted up to a lifted position relative to the associated watercraft. When the piston rod comes into the cylinder with the reversed activation of the working fluid, then the outboard drive is tilted down to a lowered position.

Some of the hydraulic tilt devices for relatively small outboard motors have a manually operable switchover valve in a passage that connects the pair of the fluid chambers with each other and an operator of the outboard motor can switch the passage between a communication state and a non-communication state. When the passage is in the communication state, the operator may tilt up or tilt down the outboard drive without any restraint. Meanwhile, by bringing the passage to the non-communication state, the outboard drive will not be moved and stay at any position that the operator desires.

The majority of the hydraulic tilt devices contain gasses in said cylinder or an accumulation chamber, which is provided separately from the cylinder, for compensating the capacity of the working fluid being out of the cylinder, because gasses are compressive.

FIGS. 1 and 2 illustrate cross-sectional side views of some exemplary hydraulic tilt devices which are conventionally used. The tilt devices includes a cylinder 20, a piston 22, a piston rod 24, a passage 26 and a switchover valve 28 which are described above. A working fluid 30 fills both chambers of the cylinder 20. A floating piston 32 is additionally provided in the cylinder 20. This floating piston 32 slides in the cylinder 20 with the piston 24 as a unit except under the condition that a submerged obstacle strikes the outboard motor. In addition, the tilt device shown in FIG. 2 further has an accumulator chamber 34 communicated with a chamber 36 where the piston rod 24 does not extend. The chamber 36, in other words, is the opposite chamber relative to the other chamber 37 where the piston rod 24 extends. Gasses 38 are contained in the chamber 36 or the accumulator chamber 34.

The hydraulic tilt device as such constructed has a problem. When the outboard motor is operated, the thrust force is exerted upon the gasses 38 because the piston rod 24 comes into the cylinder 20 by the thrust force and pushes the unit of the piston 22 and the floating piston 32 toward the gasses 38. Since the gasses are compressive, at some occasion they accept this thrust force and some other occasion they push back. This gives the operator a kind of "floating feeling" and the operator is likely to believe that the operational performance of the outboard motor is not so good.

FIG. 3 illustrates a cross-sectional side view showing another type of tilt device that can be proposed for resolving the problem. In this tilt device, gasses 38 exclusively exert onto the working fluid 30 in the chamber 37 where the piston rod 24 extends when the switchover valve 28 closes the passage 26. Thus, the phenomenon coming with the tilt devices shown in FIGS. 1 and 2 no longer occur with this tilt device. However, another problem arises particularly with this arrangement, not limited to though.

The problem tends to appear when the associated watercraft is running in shallow water. Usually, the drive unit of the outboard motor is lifted up to a tilt range and powered with a low or medium speed in this situation so that submerged obstacles might not strike it. Under the circumstances, if the operator powers up the engine of the outboard motor to run it at a full speed without lowering down the drive unit, the propeller thrust is headed downwardly as well as forwardly. Such a downward thrust, then, raises the bow of the associated watercraft. If this happens abruptly, the watercraft may lose balance.

With the tilt devices shown in FIGS. 1 and 2, the "floating feeling" is amplified when the operator tries to power up the engine and the operator can relatively easily notice that the situation could happen. Accordingly, the problem is not so serious with those tilt devices. However, it is desirable to avoid this problem even in using the tilt devices shown in FIGS. 1 and 2.

Further, the problem may appear even with hydraulic tilt devices that contain no gasses therein but have a reservoir containing surplus fluid for compensating the capacity of the piston rod. This type of hydraulic tilt devices is also conventional.

It is, therefore, a principal object of this invention to provide a hydraulic tilt device thereby a drive unit can be lowered down when an engine is powered up under the condition that the drive unit is tilted up for advancing in a shallow water.

It is another object of this invention to provide a hydraulic tilt device thereby the "floating feeling" does not occur and a drive unit can fall down in the same situation as described above even though the operator do not have the "floating feeling".

A conventional hydraulic tilt device usually has a shock absorber mechanism thereby an underwater obstacle can be safely cleared. It is desirable to have the relief function in the shallow water running with reserving the function of the shock absorber mechanism.

It is, therefore, a further object of this invention to provide a hydraulic tilt device that can achieve the relief function in the shallow water running as well as the shock absorber function.

SUMMARY OF THE INVENTION

This invention is adapted to be embodied in a hydraulic tilt device for a marine outboard drive.

In accordance with one aspect of this invention, the hydraulic tilt device comprises a cylinder. A piston is slidably supported in the cylinder and defining a first chamber and a second chamber in the cylinder. A working fluid is contained in the first and second chambers. A piston rod extends from the piston through the first chamber. A passage is disposed outside of the piston and joins the first and second chambers together. A switchover valve is disposed in the passage for switching the passage between a communication state and a non-communication state. Gasses are contained for compensating the working fluid and pressuring the working fluid in the first chamber when the passage is in the non-communication state. Means are provided for permitting flow of the working fluid from the second chamber to the first chamber when the passage is in the non-communication state and the second chamber produces a pressure greater than a predetermined magnitude.

In accordance with another aspect of this invention, the hydraulic tilt device comprises a cylinder. A piston is slidably supported in the cylinder and defining a first chamber and a second chamber in the cylinder. The first and second chambers are filled with a working fluid. A piston rod extends from the piston through the first chamber. A passage is disposed outside of the piston and joins the first and second chambers together. A switchover valve is disposed in the passage for switching the passage between an open state and a closed state. Means are provided for bypassing the switchover valve when the passage is in the closed state and the second chamber produces a pressure greater than a predetermined magnitude.

In accordance with a further aspect of this invention, a method of operating a hydraulic tilt device is proposable. The hydraulic tilt device includes a cylinder. A piston is slidably supported in the cylinder and defining a first chamber and a second chamber in the cylinder. The first and second chambers are filled with a working fluid. A piston rod extends from the piston through the first chamber. A first passage is disposed outside of the piston and joins the first and second chambers together. A switchover valve is disposed in the first passage for switching the first passage between a communication state and a non-communication state. A second passage bypasses the switchover valve. The method comprises the steps of maintaining the first passage in the non-communication state by the switchover valve, and permitting flow of the working fluid through the second passage when the second chamber produces a pressure greater than a predetermined magnitude.

Further aspects, features and advantages of this invention will become apparent from the detailed description of the preferred embodiments which follow.

BRIEF DESCRIPTION OF THE DRAWINGS

As noted above,

FIG. 7(A) shows a usual situation wherein a drive unit of the outboard motor is held in a desired position.

FIG. 8(A) shows that a check valve is formed with an exchangeable member in the hydraulic tilt device.

DETAILED DESCRIPTION OF THE PREFERRED EMBODIMENTS OF THE INVENTION

Figure 1:
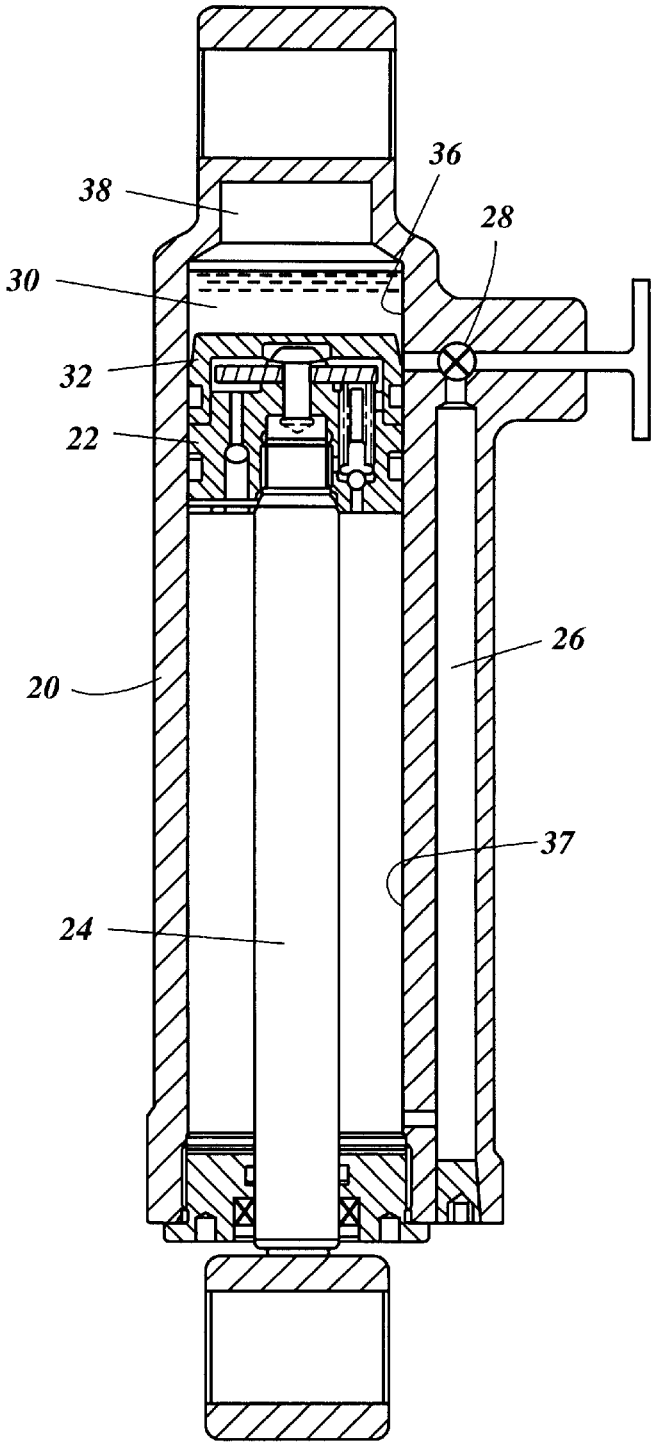
Figure 1 Prior Art
FIGS. 1 and 2 illustrate cross-sectional side views of some exemplary hydraulic tilt devices which are conventionally used.
Figure 2:
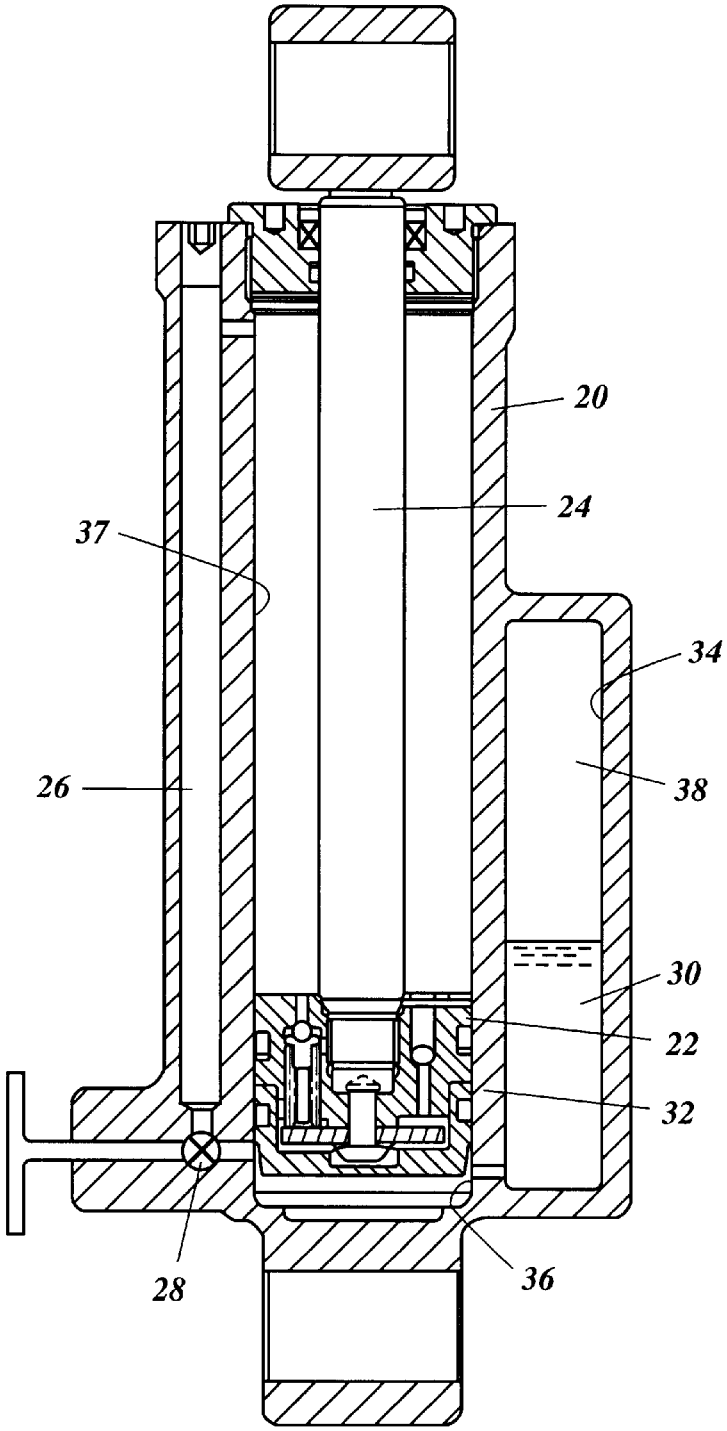
Figure 2 Prior Art
Figure 3:
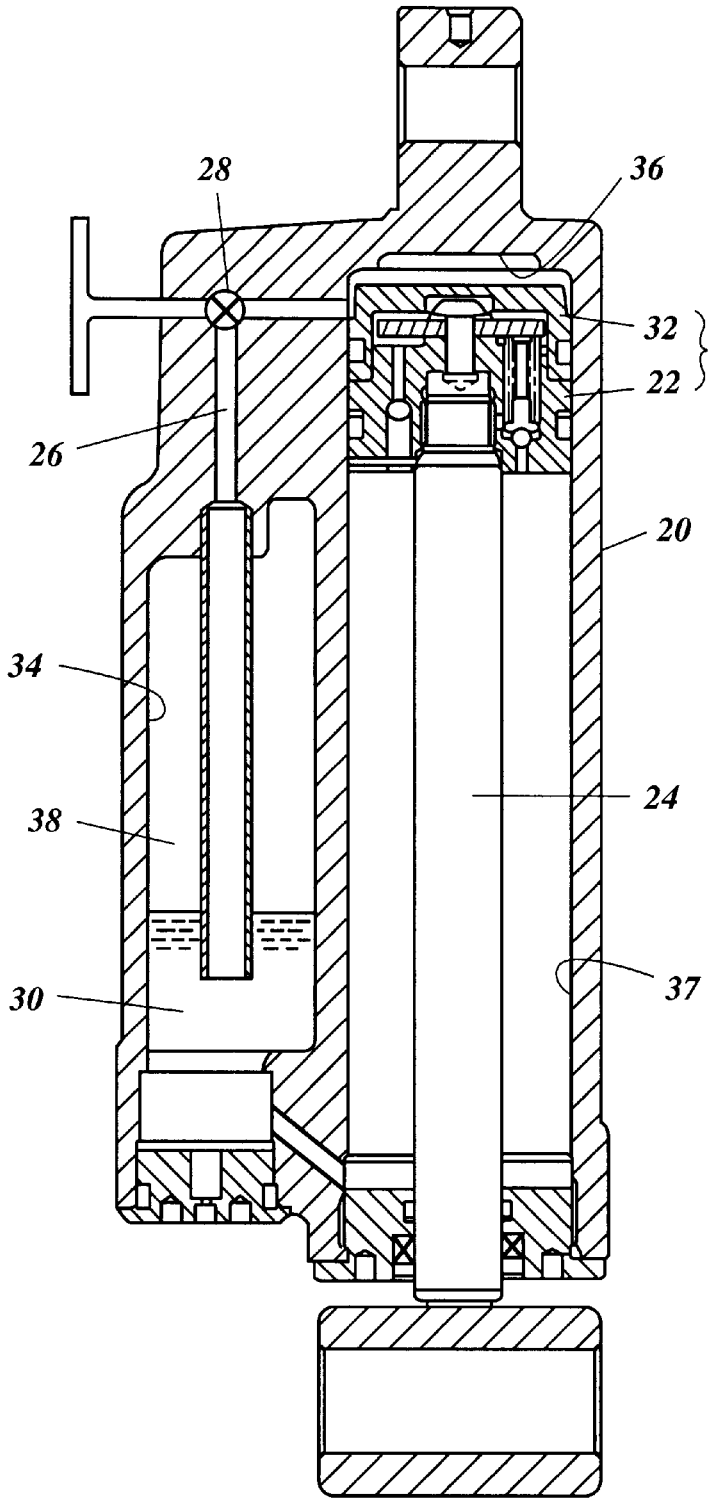
FIG. 3 also illustrates a cross-sectional side view showing another type of tilt device that can be proposed for resolving the problem occurred with the tilt devices shown in FIGS. 1 and 2. These figures are provided in order to assist the reader's understanding of problems and for the reader to better appreciate the aspects, features and advantages associated with this invention.
Figure 4:
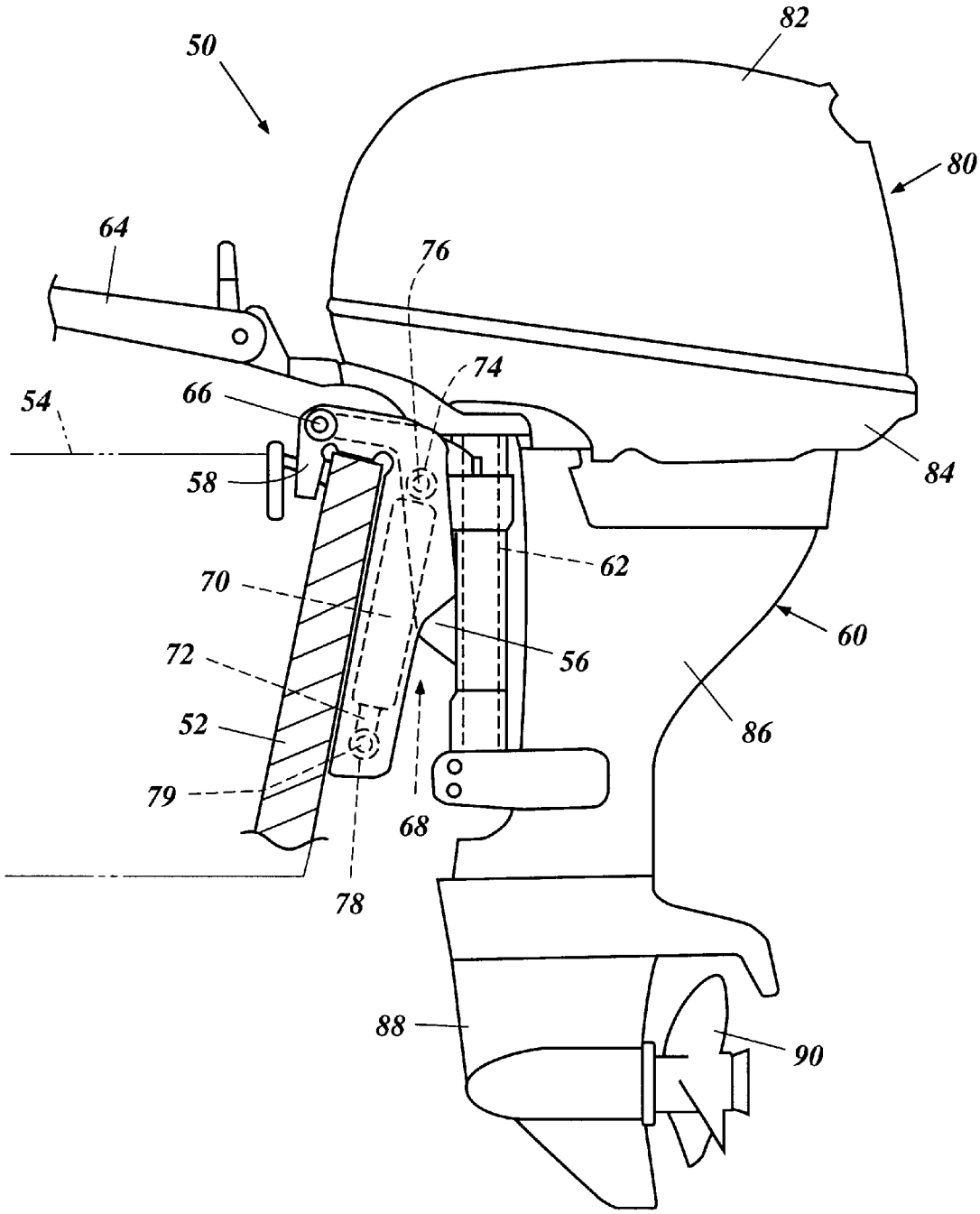
FIG. 4 is a side elevational view showing an outboard motor having a hydraulic tilt device embodying features of this invention, and mounted on an associated watercraft which is partially shown. A transom of the watercraft is sectioned.

At first, the general overall environment of an exemplary outboard motor wherein a hydraulic tilt device embodying features of this invention is practiced will be described with reference to FIG. 4.

The outboard motor generally indicated by the reference numeral 50 is mounted on the transom 52 of the associated watercraft 54 by a swivel bracket 56 and a cramp bracket 58. A drive unit generally indicated by the reference numeral 60 of the outboard motor 50 is pivotally supported around a generally vertically extending axis or steering shaft 62 of the swivel bracket 56. This connection allows the drive unit 60 to be steered with a steering handle 64. Meanwhile, the swivel bracket 56 is pivotally supported around a generally horizontally extending axis 66 of the cramp bracket 58 so that its tilting movement is practicable also. The outboard motor 50 has a hydraulic tilt device generally indicated by the reference numeral 68 between the swivel bracket 56 and the cramp bracket 58 for the tilting movement. The hydraulic tilt device 68 includes a cylinder 70 and a piston rod 72 extending from a piston, which will be described later with reference to FIG. 5. One end of the cylinder 70 has a trunnion 74 that permits pivotal attachment of the cylinder 70 to the swivel bracket 56 by means of a pivot pin 76. In a like manner, the exposed end of the piston rod 72 is also formed with a trunnion 78 that accommodates a pivot pin 79 so as to provide a pivotal connection to the cramp bracket 58. The hydraulic tilt device 68 will be described in more detail shortly.

A power head generally indicated by the reference numeral 80 is located at the top of the drive unit 60. The power head 80 includes a powering engine (not shown), a protective top cowling 82 and a bottom cowling 84. The top cowling 82 and the bottom cowling 84 encircle the engine for protecting the engine. For example, water is prevented from splashing over the engine. The top cowling 82 is detachably affixed to the bottom cowling 84 so as to ensure access to the engine for maintenance. The engine operation can be accelerated or decelerated by an accelerator (not shown) that is affixed on the steering handle 64, as is well known.

The drive unit 60 has an upper housing 86 extending under the power head 80 and a lower housing 88 continuously extending under the upper housing 86. The upper and lower housings 86, 88 contain a driveshaft (not shown) extending vertically to transmit the rotational power of a crankshaft (not shown) to a propeller shaft (not shown) in the lower housing 88. A propeller 90 is affixed at the end of the propeller shaft. Thus, the output power of the engine power is transmitted to the propeller 78 through the driveshaft and the propeller shaft. With forward or reverse rotation of the propeller 90, the associated watercraft 54 advances forward or backward.

Figure 5:
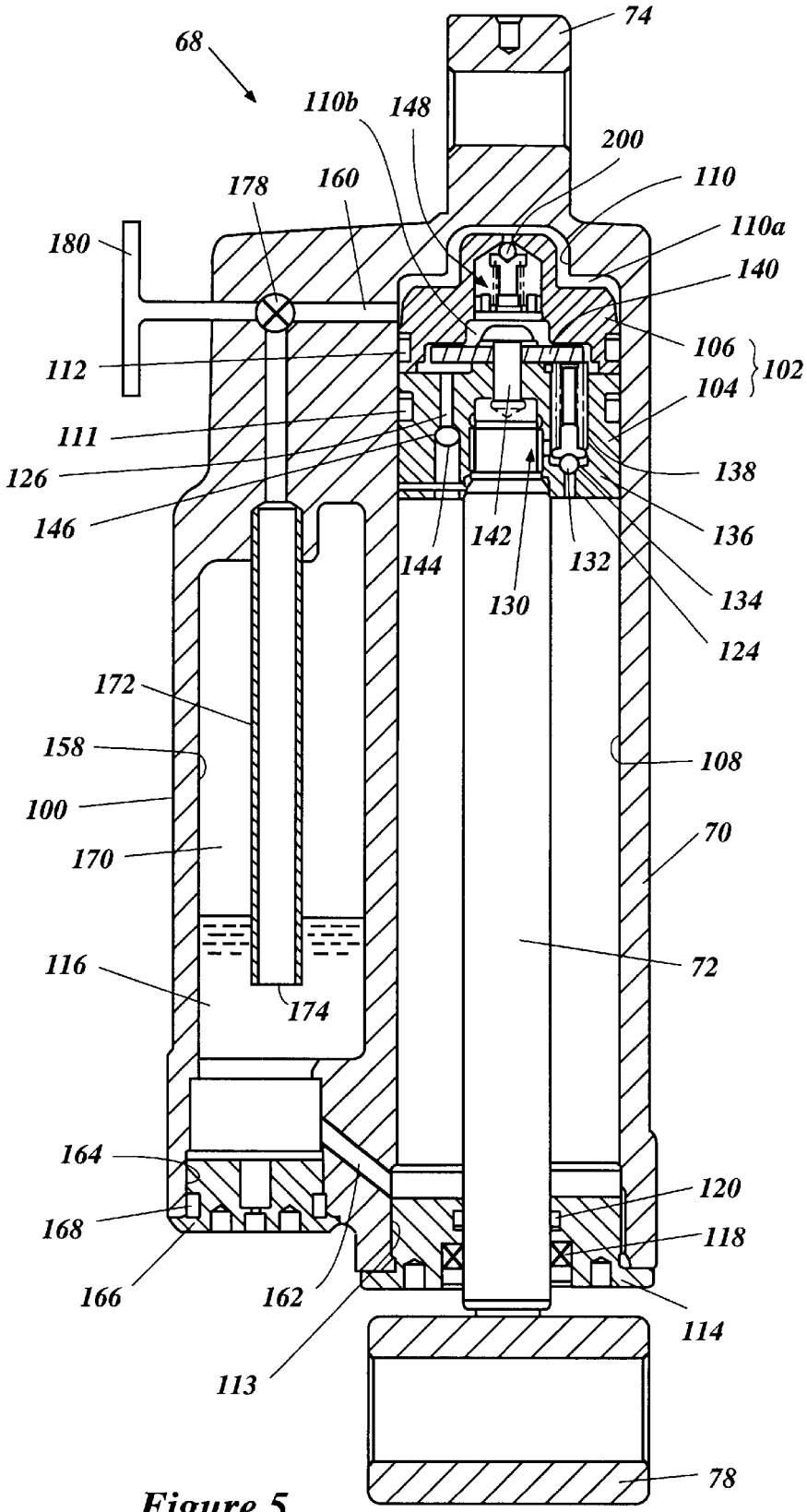
FIG. 5 is a cross-sectional, enlarged side elevational view showing the hydraulic tilt device.

Referring to FIG. 5, the hydraulic tilt device 68 is generally formed with the cylinder 70 and an accumulator 100 integrated with the cylinder 70. A piston assembly 102 is provided in the cylinder 70. The piston assembly 102 comprises a primary piston or fixed piston 104 and a secondary piston or floating piston 106, both of which are slidable in the cylinder 70. The fixed piston 104 will be simply called as "the piston 104" unless there is necessary to be particularly distinguished from the floating piston 106 in the following descriptions. The piston 104 defines a lower chamber 108 and an upper chamber 110. The floating piston 106 is, therefore, located in the upper chamber 110 and divides the upper chamber 110 into an upper space 110*a* and a lower space 11*b*. The inner end of the piston rod 72 is fixed to the piston 104 and the piston rod 72 extends downwardly therefrom. An O-ring 111 is provided around the piston 104 and an O-ring 112 is also provided around the floating piston 106.

The upper end of the cylinder 70 is closed. Meanwhile, the lower end of the cylinder 70 is formed with an opening 113 from which the piston rod 72 extends outside. The opening 113 is closed by a plug 114. This plug 114 supports the piston rod 72 slidably so that the piston rod 72 can go out and come into the cylinder 70 without receiving any resistive force. The lower chamber 108 and the upper chamber 110 are filled with a working fluid 116. Thus, a seal member 118 and an O-ring 120 are provided around the piston rod 72 to prevent the working fluid 116 from leaking out.

Returning to the piston 104, it has two passages 124, 126 both communicating to the lower chamber 108 and the upper chamber 110. The passage 124 is a relief passage for releasing the working fluid 116 in the lower chamber 108 to the upper chamber 110 in case a submerged obstacle is struck the lower housing 88 of the drive unit 60. Also, the passage 126 is a return passage through which the working fluid 116 returns to the lower chamber 108 from the upper chamber 110. The relief passage 124, thus, contains a check valve or shock absorber valve 130 permitting flow of the working fluid 116 only from the lower chamber 108 to the upper chamber 110 when the lower chamber 108 produces a pressure grater than a predetermined magnitude.

The check valve 130 includes a ball 132 seated at a valve seat 134 in the relief passage 124, a retainer 136 retaining the ball 132 and a spring 138 urging the retainer 136 toward the ball 132. The spring 138 is supported by a disc plate 140, which is affixed to the piston 104 with a rivet 142, and will press the retainer 136 toward the ball 132. Thus, the ball 132 is held in the closed position unless sufficient force is exerted on it. In the meantime, a ball or a return valve 144 seated at a valve seat 146 closes the return passage 126 and permits flow of the working fluid 116 only from the upper chamber 110 to the lower chamber 108.

The floating piston 106 functions to primarily provide a memory of an original position when the piston 104 is moved by a strike of a submerged obstacle. That is, the floating piston 106 will never move and stay at the position where it is under that condition. In all situations other than the situation in which the underwater is struck, the floating piston 106 moves together with the piston 104 as a unit always. The floating piston 106 has a check valve 148 that permits flow of the working fluid 116 only from the upper chamber 110 to the lower space 110*b* between the floating piston 106 and the fixed piston 104 when the upper space 110*a* produces a pressure greater than a predetermined magnitude. This check valve 148 provides particular advantages and will be described in more detail later.

The accumulator 100 is integrated with the cylinder 70 as described above. The accumulator 100 has a chamber 158 communicates to the upper chamber 110 through an upper passage 160 and to the lower chamber 108 through a lower passage 162. The lower end of the accumulator 100 is formed with an opening 164. The opening 164 is closed with a plug 166 and an O-ring 168 is provided around the plug 166 to keep the closure fluid-tightly.

The accumulator chamber 158 contains gasses 170 to fill the rest of the capacity in which some of the working fluid 116 is already contained. The gasses 170 can compensate the volume where the piston rod 72 has occupied after the piston rod 72 went out of the cylinder 70 because the gasses 170 are compressive. A pipe 172 is fitted into the upper passage 160 to extend it to the working fluid 116 accumulated at the bottom of the accumulator chamber 158. That is, at least the bottom end 174 of the pipe 172 is always positioned in the working fluid 116 even whole of the piston rod 72 exists in the cylinder 70 (the state shown in FIG. 5). Accordingly, the upper chamber 110 and the lower chamber 108 are joined together through the upper passage 160, the pipe 172, the accumulator chamber 158 and the lower passage 162.

The hydraulic tilt device 68 has a switchover valve 178 disposed in the upper passage 160 to switch the upper passage 160 between a communication or open state and a non-communication or closed state. A handle bar 180 extends from the switchover valve 178 for manually switching over the valve 178. When the switchover valve 178 is opened by manually operating the handle bar 180 and the upper passage 160 is in the communication state, the operator can tilt up the drive unit 60 by himself or herself with the simple action to raise it up by hand. On the other hand, when the operator closes the switchover valve 178 at an position where he or she wants to hold the drive unit 60 and hence the upper passage 160 is in the non-communication state, the drive unit 60 will be held at that position even the operator releases it. This means that the drive unit 60 can be kept at any desired tilted position.

Figure 6:
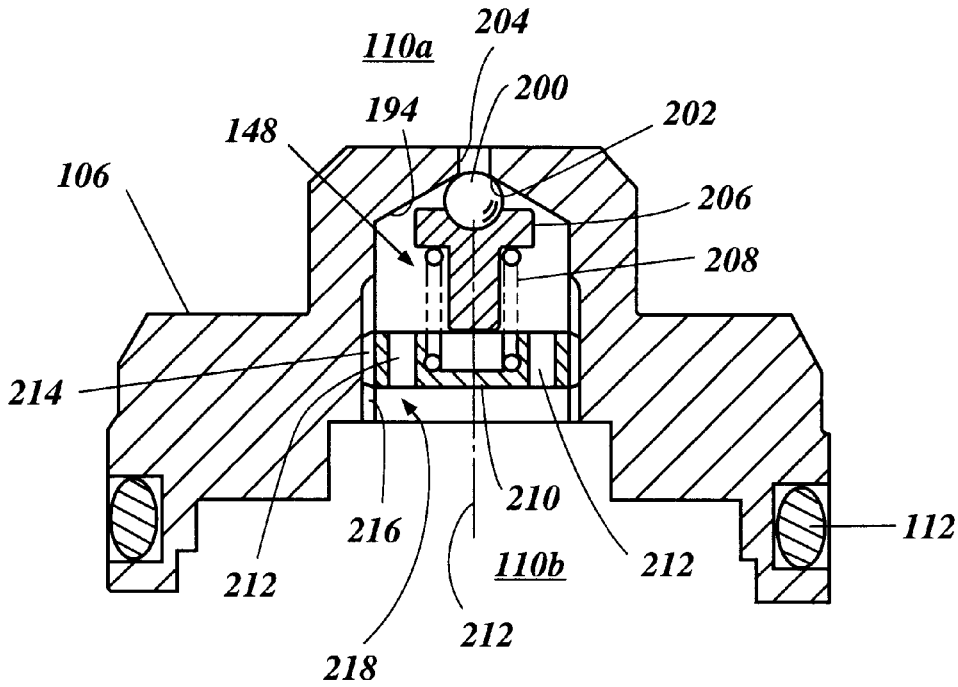
FIG. 6 is a cross-sectional, enlarged side elevational view showing a floating piston incorporated in the hydraulic tilt device.

The floating piston 106 will now be described in more detail with reference to FIG. 6.

The floating piston 106 has a recess 194 and the check valve 148 is placed in the recess 194 for permitting the flow of the working fluid 116 only from the upper space 110*a* to the lower space 110*b* in the upper chamber 110. A ball 200 is seated at a valve seat 202 which is formed at a communication passage 204. The ball 200 is retained by a retainer 206 and a spring 208 is provided between the retainer 206 and a spring supporter or bed 210. The spring 208 urges the retainer 206 toward the ball 200 so that the ball 200 tightly closes the passage 204. That is, like the check valve 130, the ball 200 is held in the closed position unless sufficient force is exerted on the ball 200. The spring bed 210 also divides a compartment 196, in which the ball 200, the retainer 206 and the spring 208 is accommodated, from the lower space

110*b*. However, the spring bed 210 has a plurality of apertures 212 through which the compartment 198 can communicate with the lower space 110*b*.

The outer periphery of the spring bed 210 is formed with a male thread 214, while the recess 194 is provided with a female thread 216. The male thread 214 is mated with the female thread 216. This thread or screw connection of the spring bed 210 to the recess 194 forms an adjustment mechanism 218 thereby the urging force of the spring 208 can be adjusted. That is, the spring bed 210 is movable along an axis 212 of the urging force, i.e., the spring 208 per se. When the spring bed 210 goes up, the urging force is increased. Meanwhile, when the spring bed 210 is goes down, the urging force is decreased. This means that a sensitivity of the check valve 148 is adjustable by this adjustment mechanism 218. This adjustment mechanism 218 is useful for setting up the urging force or spring force to be suited to various types of tilt devices 68.

Because of the check valve 148 in the floating piston 106, if a pressure exceeds a predetermined magnitude in the upper chamber 110, a sufficient force will be exerted onto the ball 200 so as to remove it from the valve seat 202 against the spring force. Thus, the working fluid 116 in the upper space 110*a* may flow into the lower space 110*b* between the floating piston 106 and the fixed piston 104. This fluid 116, then, immediately goes to the lower chamber 108 through the passage 126 in the fixed piston 104 because no restriction is made in the flow of this direction in the fixed piston 104.

Figures 7A, 7B, 7C:
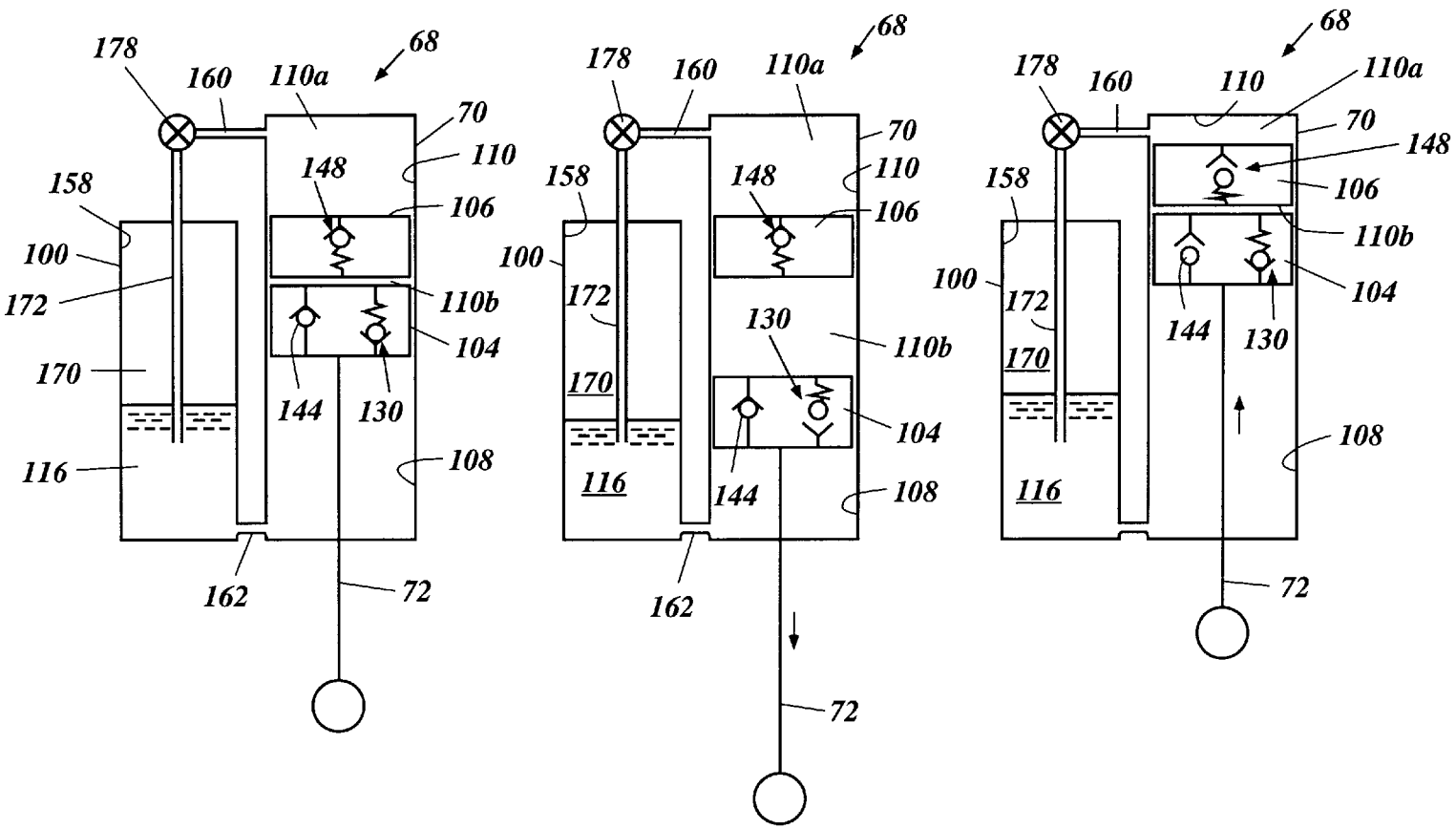
FIGS. 7(A), (B), (C) are schematic views showing some situations in which the hydraulic tilt device is used.
FIG. 7(B) shows an unusual situation wherein an underwater obstacle is struck the drive unit.
FIG. 7(C) shows also an unusual situation wherein unanticipated thrust force is exerted to the drive unit when it is slightly tilted up during advancing in shallow water.

Referring now to FIGS. 7(A), (B), (C), some usual and unusual situations will be described hereunder.

In FIG. 7(A), the switchover valve 178 is manually closed and hence the upper passage 160 is in the non-communication state. Since the drive unit 60 falls down by its weight, the piston rod 72 is coming into the cylinder 70 and this movement produces some pressure in the upper chamber 110. However, since such a pressure does not exceed the predetermined magnitude, the check valve 148 will not be opened. Meanwhile, no force is exerted on the check valve 130. Thus, both of the pistons 104, 106 stay at each position and the drive unit 60 is held at the tilted position. It should be particularly noted that gasses 170 in the accumulator chamber 158 exert pressure only onto the working fluid 116 in the lower chamber 108 of the cylinder 70 when the upper passage 160 is shut down by the switchover valve 178.

In FIG. 7(B), when the outboard motor 50 advances in a forward direction and if an underwater obstacle hits the lower housing 88, the piston rod 72 will exert sufficient force on the piston 104 so as to overcome the action of the check valve 130 and permit the piston 104 to move downwardly and the drive unit 60 to pop up. This movement urges the working fluid 116 in the lower chamber 108 to flow to the upper chamber 110 under the floating piston 106. Thus, the fixed piston 104 may go down and the drive unit 60 is popped up. In the meantime, the floating piston 106 stays at the position where it is. That is, the original position of the fixed piston 104 is memorized in the cylinder 70.

Once the underwater obstacle has been cleared, the weight of the drive unit 60 acting on the piston rod 72 and the piston 104 will cause the return valve 144 to open and permit the working fluid 116 to flow back to the lower chamber 108 from the lower space 110*b* in the upper chamber 110. Since the floating piston 106 has not moved, the fixed piston 104 returns to the position where the floating piston 106 exists and stops there. Thus, the drive unit 60 returns to the original tilted position and stays at this position.

In FIG. 7(C), on the other hand, when the drive unit 60 is slightly tilted up for advancing in a shallow water, for example, as shown in FIG. 7(A), if the operator inadvertently operates the accelerator so as to power up the engine operation, huge thrust force is generated by the propeller 90 and the piston rod 72 is urged to come into the cylinder 70 by the force. This thrust force also produces a pressure grater than a predetermined magnitude in the upper chamber 110. The pressure is sufficient to open the check valve 148 and the working fluid 116 in the upper space 110*a* will flow through the passage 204 on the floating piston 106 to the lower space 110*b*. The lower space 110*b*, however, is very small because the fixed piston 104 and the floating piston 106 move as a unit actually. Thus, the working fluid 116 immediately goes to the lower chamber 108 through the return valve 144. Accordingly, the both pistons 104, 106 may go up and hence the drive unit 60 can tilted down. In other words, the drive unit 60 will be lowered down automatically.

As aforedescribed with regard to the situation shown in FIG. 7(A), gasses 170 in the accumulator chamber 158 exert pressure only onto the working fluid 116 in the lower chamber 108 of the cylinder 70 when the upper passage 160 is shut down by the switchover valve 178. Because of this, the operator will not have the "floating feeling" during operations of the outboard motor 50.

In addition to that, as described in connection with the situation shown in FIG. 7(C), when the operator inadvertently increases the engine speed of the outboard motor 50 which advances in the shallow water with the drive unit 60 tilted up, the drive unit 60 will be lowered down without any action by the operator. This means that the operator does not need any warning sign such as an amplified "floating feeling".

It is useful to put the check valve 148 in the floating piston 106 that can afford easy exchange as compared with other members. Further, it is also advantageous to be provided with the adjustment mechanism 218 for the check valve 148. Because such a floating piston can be easily internalized in any hydraulic tilt devices and such a check valve will be adjustable to be suited to any kind of hydraulic tilt devices and hence eventually to any kind of marine outboard drives.

Other embodiments of this invention will now be described with reference to FIGS. 8(A), (B). The same members and components as described above with reference to FIGS. 1 through 7(A),(B),(C) are assigned with the same reference numerals and will not be described again for avoiding redundancy.

Figure 8B:
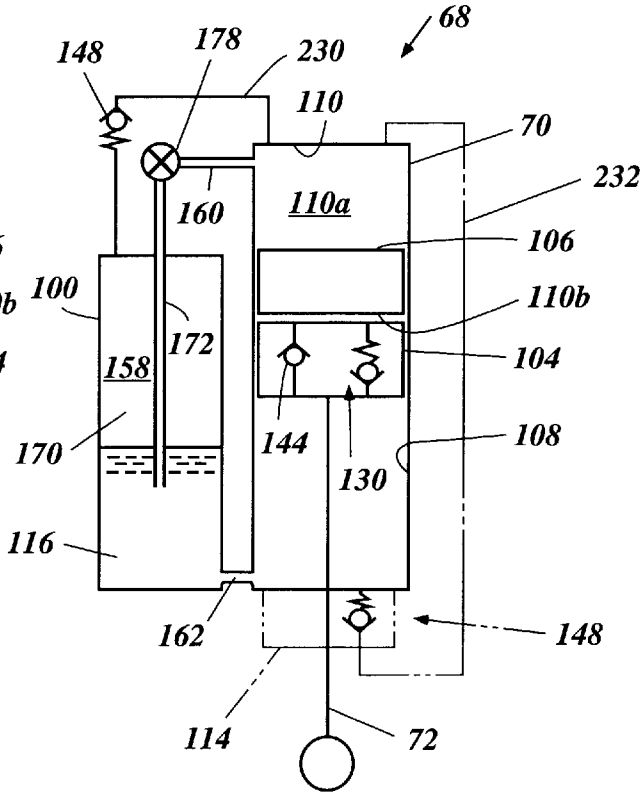
FIG. 8(B) shows two embodiments, one of which is an arrangement in which the check valve is provided in a separate bypass passage. This is indicated in actual line. The other one is an arrangement wherein the check valve is formed with another exchangeable member in the hydraulic tilt device. This is indicated in phantom line.
Figure 8A:
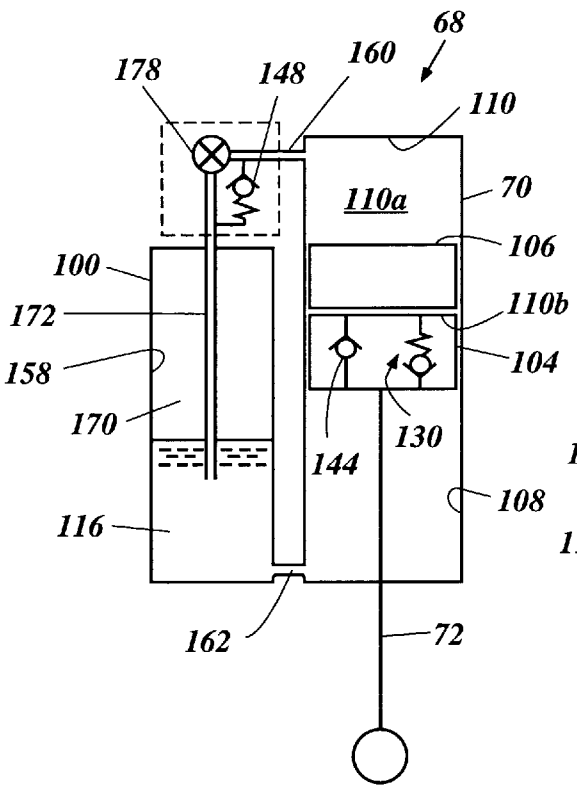
FIGS. 8(A), (B) are schematic views showing other embodiments of this invention.

FIG. 8(A) shows that the check valve 148 is formed with the switchover valve 178, but the check valve 148 bypasses the switchover valve 178. The floating piston 106 has neither a passage nor a check valve therein. The working fluid 116 in the upper chamber 116 of the cylinder 70 can move to the lower chamber 108 through the upper passage 160, check valve 148, pipe 172, accumulator chamber 158 and lower passage 162. Since the switchover valve 178 is an exchangeable member like the floating piston 106, the same advantages as that obtained with the floating piston 106 are available.

The check valve 148 can be provided not only at such an exchangeable member but also at any portion of the hydraulic tilt device 68. FIG. 8(B) shows such embodiments. The check valve 148 can be placed in a separate bypass line 230 detouring the switchover valve 178 indicated by the actual line. The check valve 148 can also be placed in another line 232 bypassing the switchover valve 178 as indicated in phantom line. Further, even though the bypass line 232 is used, it is desirable to put the check valve 148 at an exchangeable member such as a plug like the plug 114 as also indicated in this figure with the phantom line. If the cylinder 70 had an opening at the upper chamber 110 and closed with a plug, the check valve 148, of course, might be provided on this plug. Like the arrangement shown in FIG. 8(A), the floating piston 106 has neither a passage nor a check valve therein.

It should be noted that the accumulator chamber is dispensable. If the accumulator chamber is not provided, gasses are contained, for example, in the lower chamber. However, it is somewhat difficult to keep the gasses at the bottom of the lower chamber. Thus, it is advisable to be equipped with the accumulator chamber.

Also, gasses are dispensable if the hydraulic tilt device is provided with a reservoir connected to the lower chamber, that can supply working fluid compensating the capacity of the piston rod.

Further, the floating piston is dispensable if the shock absorber valve is not provided in the fixed piston. However, the arrangement, in which both of the fixed piston including the shock absorber valve and the return passage and the floating piston including the relief valve are provided, is particularly useful. Because, the relief function under the condition advancing in shallow water is obtained in a relatively neat fashion without influencing the shock absorber function Further, the hydraulic tilt device embodying the features of this invention can be applicable not only for outboard motors but also for other marine outboard drives such as stern drives.

Moreover, although the hydraulic tilt device is quite useful for relatively small outboard drives, it can be employed to larger outboard drives also.

Of course, the foregoing description is that of preferred embodiments of the invention, and various changes and modifications may be made without departing from the spirit and scope of the invention, as defined by the appended claims.

What is claimed is:

1. A hydraulic tilt device for a marine outboard drive comprising a cylinder, a piston slidably supported in said cylinder and defining a first chamber and a second chamber in said cylinder, a working fluid being contained in said first and second chambers, a piston rod extending from said piston through said first chamber, a passage disposed outside of said piston and joining said first and second chambers together, a switchover valve disposed in said passage for switching said passage between a communication state and a non-communication state, the working fluid being permitted to flow from said first chamber to said second chamber and from said second chamber to said first chamber in the communication state, a contained volume of gas arranged to pressurize the working fluid in said first chamber when said passage is in the non-communication state, and means for permitting flow of the working fluid from said second chamber to said first chamber when said passage is in the non-communication state and a pressure greater than a predetermined magnitude occurs in at least a portion of said second chamber.

2. A hydraulic tilt device as set forth in claim 1 wherein said tilt device further comprises a floating piston supported slidably in said second chamber and dividing the second chamber into one space and another space, and said means for permitting flow of the working fluid includes a relief passage disposed in said floating piston and communicating with said one space and said another space.

3. A hydraulic tilt device as set forth in claim 2 wherein said relief passage has a relief valve for permitting flow of the working fluid from said another space to said one space when said passage is in the non-communication state and a pressure greater than a predetermined magnitude occurs in said another space.

4. A hydraulic tilt device as set forth in claim 3 wherein said relief valve comprises a closure member for closing said relief passage, a retainer for retaining said closure member relative to said relief passage, an urging member for exerting an urging force onto said retainer and a supporter for supporting said urging member.

5. A hydraulic tilt device as set forth in claim 2 wherein said one space exists between said floating piston and said piston, and said means for permitting flow of the working fluid further include a second relief passage disposed in said piston and communicating with said one space and said first chamber.

6. A hydraulic tilt device as set forth in claim 5 additionally comprising a third relief passage disposed in said piston and communicating with said one space and said first chamber, wherein said third relief passage has a shock absorber valve permitting flow of the working fluid from said first chamber to said second chamber when a pressure greater than a predetermined magnitude occurs in said first chamber.

7. A hydraulic tilt device as set forth in claim 1 wherein said means for permitting flow of the working fluid is disposed in said piston.

8. A hydraulic tilt device as set forth in claim 7 wherein said piston comprises a primary piston being connected with said piston rod and a secondary piston existing in said second chamber, and said means for permitting flow of the working fluid includes a passage disposed in said primary piston and another passage disposed in said secondary piston.

9. A hydraulic tilt device as set forth in claim 1 wherein said means for permitting flow of the working fluid bypasses said switchover valve.

10. A hydraulic tilt device as set forth in claim 1 wherein said means for permitting flow of the working fluid includes a bypass passage and a relief valve disposed in said bypass passage.

11. A hydraulic tilt device as set forth in claim 10 wherein said relief valve is formed at an exchangeable member that can be detached from hydraulic tilt device.

12. A hydraulic tilt device as set forth in claim 11 wherein at least one of said first and second chambers has an opening closed by a plug, and said exchangeable member includes said plug.

13. A hydraulic tilt device as set forth in claim 1 additionally comprising an accumulator provided separately from said cylinder, wherein said accumulator has an accumulator chamber communicating with said first chamber and containing the volume of gas.

14. A hydraulic tilt device as set forth in claim 13 wherein said accumulator is unitarily formed with said cylinder.

15. A hydraulic tilt device as set forth in claim 13 wherein said first and second chambers are filled with the working fluid.

16. A hydraulic tilt device for a marine outboard drive comprising a cylinder, a piston slidably supported in said cylinder and defining a first chamber and a second chamber in said cylinder, a working fluid being contained in said first and second chambers, a piston rod extending from said piston through said first chamber, a passage disposed outside of said piston and joining said first and second chambers together, a switchover valve disposed in said passage for switching said passage between a communication state and a non-communication state, a contained volume of gas arranged to pressurize the working fluid in said first chamber when said passage is in the non-communication state, means for permitting flow of the working fluid from said second chamber to said first chamber when said passage is in the non-communication state and a pressure greater than a predetermined magnitude occurs in at least a portion of said second chamber, and a floating piston supported slidably in said second chamber and dividing the second chamber into one space and another space, said means for permitting flow of the working fluid including a relief passage disposed in said floating piston and communicating with said one space and said another space, said relief passage having a relief valve for permitting flow of the working fluid from said another space to said one space when said passage is in the non-communication state and a pressure greater than a predetermined magnitude occurs in said another space, and said means for permitting flow of the working fluid having an adjustment mechanism for adjusting a sensitivity of said relief valve.

17. A hydraulic tilt device for a marine outboard drive comprising a cylinder, a piston slidably supported in said cylinder and defining a first chamber and a second chamber in said cylinder, a working fluid being contained in said first and second chambers, a piston rod extending from said piston through said first chamber, a passage disposed outside of said piston and joining said first and second chambers together, a switchover valve disposed in said passage for switching said passage between a communication state and a non-communication state, a contained volume of gas arranged to pressurize the working fluid in said first chamber when said passage is in the non-communication state, means for permitting flow of the working fluid from said second chamber to said first chamber when said passage is in the non-communication state and a pressure greater than a predetermined magnitude occurs in at least a portion of said second chamber, and a floating piston supported slidably in said second chamber and dividing the second chamber into one space and another space, said means for permitting flow of the working fluid including a relief passage disposed in said floating piston and communicating with said one space and said another space, said relief passage having a relief valve for permitting flow of the working fluid from said another space to said one space when said passage is in the non-communication state and a pressure greater than a predetermined magnitude occurs in said another space, said relief valve including a closure member for closing said relief passage, a retainer for retaining said closure member relative to said relief passage, an urging member for exerting an urging force onto said retainer, and a supporter for supporting said urging member, said supporter being movable along a vector of the urging force exerted by said urging member.

18. A hydraulic tilt device as set forth in claim 17 wherein said urging member is mounted on said floating piston by a screw connection.

19. A hydraulic tilt device for a marine outboard drive comprising a cylinder, a piston slidably supported in said cylinder and defining a first chamber and a second chamber in said cylinder, a working fluid being contained in said first and second chambers, a piston rod extending from said piston through said first chamber, a passage disposed outside of said piston and joining said first and second chambers together, a switchover valve disposed in said passage for switching said passage between a communication state and a non-communication state, a contained volume of gas arranged to pressurize the working fluid in said first chamber when said passage is in the non-communication state, and means for permitting flow of the working fluid from said second chamber to said first chamber when said passage is in the non-communication state and a pressure greater than a predetermined magnitude occurs in at least a portion of said second chamber, said means for permitting flow of the working fluid including a bypass passage and a relief valve disposed in said bypass passage, said relief valve being formed at an exchangeable member that can be detached from hydraulic tilt device, and said exchangeable member including said switchover valve.

20. A hydraulic tilt device for a marine outboard drive comprising a cylinder, a piston slidably supported in said cylinder and defining a first chamber and a second chamber in said cylinder, said first and second chambers being filled with a working fluid, a piston rod extending from said piston through said first chamber, a passage disposed outside of said piston and joining said first and second chambers together, a switchover valve disposed in said passage for switching said passage between an open state and a closed state, the switchover valve permitting the working fluid to move from said first chamber to said second chamber and from said second chamber to said first chamber in the open state, a contained volume of gas arrange to pressurize the working fluid in said first chamber when said passage is in the closed state, and means for bypassing said switchover valve when said passage is in the closed state and a pressure greater than a predetermined magnitude occurs within said second chamber.

21. A hydraulic tilt device as set forth in claim 20 wherein said tilt device further comprises a floating piston slidably supported in said second chamber and dividing the second chamber into one space and another space, and said means for bypassing said switchover valve includes a relief passage disposed in said floating piston and communicating with said one space and said another space.

22. A hydraulic tilt device as set forth in claim 21 wherein said one space exists between said floating piston and said piston, said relief passage has a relief valve for permitting flow of the working fluid from said another space to said one space when said passage is in the closed state and a pressure greater than a predetermined magnitude occurs in said another space.

23. A hydraulic tilt device for a marine outboard drive comprising a cylinder, a piston slidably supported in said cylinder and defining a first chamber and a second chamber in said cylinder, said first and second chambers being filled with a working fluid, a piston rod extending from said piston through said first chamber, a passage disposed outside of said piston and joining said first and second chambers together, a switchover valve disposed in said passage for switching said passage between an open state and a closed state, a contained volume of gas arranged to pressurize the working fluid in said first chamber when said passage is in the closed state, and means for bypassing said switchover valve when said passage is in the closed state and a pressure greater than a predetermined magnitude occurs within said second chamber, a floating piston slidably supported in said second chamber and dividing the second chamber into one space and another space, said means for bypassing said switchover valve including a relief passage disposed in said floating piston and communicating with said one space and said another space, said one space existing between said floating piston and said piston, said relief passage having a relief valve for permitting flow of the working fluid from said another space to said one space when said passage is in the closed state and a pressure greater than a predetermined magnitude occurs in said another space, and said means for bypassing said switchover valve having an adjustment mechanism for adjusting a sensitivity of said relief valve.

24. A hydraulic tilt device for a marine outboard drive comprising a cylinder, a piston slidably supported in the cylinder and defining first and second chambers in the cylinder, the first and second chambers containing working fluid, a piston rod extending from the piston through the first chamber, a fluid passage disposed external of the piston and coupling together the first and second chambers, a valve mechanism disposed in the fluid passage, the valve mechanism being capable to be set at least in a closed state, and a bypass mechanism operating independently of the valve mechanism to permit a flow of working fluid at least from the second chamber to the first chamber when the valve mechanism is in the closed state, the bypass mechanism being disposed apart from the piston and including a relief valve to selectively regulate flow through the bypass mechanism.

25. A hydraulic tilt device as in claim 24, wherein the bypass mechanism additionally includes an adjustment mechanism that adjusts a sensitivity of the relief valve.

26. A hydraulic tilt device as in claim 24, wherein the relief valve comprises a closure member, a retainer arranged to retain the closure member, a biasing member arranged to bias the closure member toward a position corresponding to the closed state, and a base member arranged to support the biasing member.

27. A hydraulic tilt device as in claim 26, wherein the base member of the relief valve is movable in a direction corresponding to a vector of a biasing force produced by the biasing member.

28. A hydraulic tilt device as set forth in claim 24 additionally comprising a floating piston slidably supported in said second chamber.

29. A hydraulic tilt device as in claim 24, wherein the bypass mechanism includes a bypass passage that connects to the fluid passage at least at a point between the valve mechanism and the first chamber and at another point between the valve mechanism and the second chamber.

30. A hydraulic tilt device as in claim 29, wherein the relief valve is disposed within the bypass passage.

31. A hydraulic tilt device for a marine outboard drive comprising a cylinder, a piston slidably supported in the cylinder and defining first and second chambers in the cylinder, the first and second chambers containing working fluid, a piston rod extending from the piston through the first chamber, a fluid passage disposed external of the piston and coupling together the first and second chambers, a valve mechanism disposed in the fluid passage, the valve mechanism being capable to be set at least in a closed state, a bypass mechanism operating independently of the valve mechanism to permit a flow of working fluid at least from the second chamber to the first chamber when the valve mechanism is in the closed state, the bypass mechanism being disposed apart from the piston and including a valve to selectively regulate flow through the bypass mechanism, and a sub-chamber coupled with one of the first and second chambers, the working fluid partially occupying the sub-chamber, a compressible fluid filling the rest of the sub-chamber to pressurize the working fluid.

32. A hydraulic tilt device for a marine outboard drive comprising a cylinder, a piston slidably supported in the cylinder and defining first and second chambers in the cylinder, the first and second chambers containing working fluid, a piston rod extending from the piston through the first chamber, a floating piston supported slidably in the second chamber and dividing the second chamber into first and second spaces, a fluid passage disposed external of the piston and the floating piston, the fluid passage coupling the first chamber with the second space of the second chamber, a switchover valve disposed in the fluid passage to switch the fluid passage between a communication state and a non-communication state, a contained volume of gas arranged to pressurize the working fluid in the first chamber when the fluid passage is in the non-communication state, the floating piston including a relief passage communicating with the first and second spaces, the relief passage having a relief valve permitting flow of the working fluid from the second space to the first space when the fluid passage is in the non-communication state and a pressure greater than a predetermined magnitude occurs in the second space, and an adjustment mechanism arranged to adjust a sensitivity of the relief valve.

33. A hydraulic tilt device for a marine outboard drive comprising a cylinder, a piston slidably supported in the cylinder and defining first and second chambers in the cylinder, the first and second chambers containing working fluid, a piston rod extending from the piston through the first chamber, a floating piston supported slidably in the second chamber and dividing the second chamber into first and second spaces, a fluid passage disposed external of the piston and the floating piston, the fluid passage coupling the first chamber with the second space of the second chamber, a switchover valve disposed in the fluid passage to switch the fluid passage between a communication state and a non-communication state, a contained volume of gas arranged to pressurize the working fluid in the first chamber when the fluid passage is in the non-communication state, the floating piston including a relief passage communicating with the first and second spaces, the relief passage having a relief valve permitting flow of the working fluid from the second space to the first space when the fluid passage is in the non-communication state and a pressure greater than a predetermined magnitude occurs in the second space, the relief valve including a closure member arranged to close the relief passage, a retainer retaining the closure member, a bias member biasing the closure member to a closing position of the relief passage via the retainer, and a support member supporting the bias member, the support member being movable along a vector of the biasing force of the bias member.

* * * * *

UNITED STATES PATENT AND TRADEMARK OFFICE

CERTIFICATE OF CORRECTION

PATENT NO. : 6,558,212 B2
DATED : May 6, 2003
INVENTOR(S) : Hideki Saito

It is certified that error appears in the above-identified patent and that said Letters Patent is hereby corrected as shown below:

Title page,
Item [73], please change "Sogi" to -- Soqi --

Signed and Sealed this

Seventeenth Day of February, 2004

JON W. DUDAS
*Acting Director of the United States Patent and Trademark Office*